United States Patent [19]

Kato et al.

[11] Patent Number: 4,519,804

[45] Date of Patent: May 28, 1985

[54] MELANGE-COLORED SHEET AND METHOD OF PRODUCING THE SAME

[75] Inventors: Hiroyasu Kato, Kyoto; Kenkichi Yagi, Otsu; Miyoshi Okamoto, Takatsuki, all of Japan

[73] Assignee: Toray Industries, Inc., Tokyo, Japan

[21] Appl. No.: 510,928

[22] Filed: Jul. 5, 1983

[30] Foreign Application Priority Data

Jul. 7, 1982 [JP] Japan ..... 57-116869

[51] Int. Cl.[3] ..... D06N 3/04; D06P 3/86; D06P 3/87; D06P 7/00

[52] U.S. Cl. ..... 8/485; 8/114.6; 8/529; 8/531; 428/91; 428/171; 428/284; 428/287; 428/289; 428/299; 428/904

[58] Field of Search ..... 8/485, 114.6, 529, 531; 428/284, 287, 91, 904, 171, 289, 299; 28/104

[56] References Cited

U.S. PATENT DOCUMENTS

| | | | |
|---|---|---|---|
| 4,051,287 | 9/1977 | Hayoshi et al. | 428/91 |
| 4,103,054 | 7/1978 | Okamoto et al. | 428/91 |
| 4,145,468 | 3/1979 | Miyoguchi et al. | 428/284 |
| 4,146,663 | 3/1979 | Ikeda et al. | 428/284 |
| 4,241,122 | 12/1980 | Asano | 428/904 |
| 4,318,949 | 3/1982 | Okamoto et al. | 428/91 |
| 4,352,705 | 10/1982 | Ozaki et al. | 428/91 |
| 4,368,227 | 1/1983 | Setsuie et al. | 428/91 |
| 4,476,186 | 10/1984 | Kato et al. | 428/300 |

*Primary Examiner*—James C. Cannon
*Attorney, Agent, or Firm*—Austin R. Miller

[57] ABSTRACT

Melange-colored sheet and method. The sheet has an inner portion having ultrafine fiber bundles and/or multi-core fibers. The surface of the sheet is composed of super-entangled ultrafine fibers and/or fine bundles of ultrafine fibers of different colors, branched from the fibers of the inner portion, so that the surface presents a melange-colored effect of at least two colors.

13 Claims, 21 Drawing Figures

MELANGE-COLORED SHEET AND METHOD OF PRODUCING THE SAME

BACKGROUND OF THE INVENTION

1. Field of the Invention

This invention relates to a novel melange-colored sheet having at least on one surface a layer of super-entangled ultrafine fibers and/or ultrafine fiber bundles comprising at least two types of ultrafine fiber, both of which are branched from the ultrafine fiber bundles and/or multi-core fibers of the inner portion. The bundles and/or multi-core fibers are different in color so that the surface presents a melange-color. This invention also relates to a method of producing said novel melange-colored sheet.

2. Related Application

This invention is related to and is an improvement upon the invention disclosed in co-pending U.S. application Ser. No. 479,970 filed Mar. 29, 1983, now U.S. Pat. No. 4,476,186.

3. Description of the Prior Art

A typical example of conventional grained artificial leather is obtained by forming layers of elastic polymer such as polyurethane on fiber substrate and providing a pattern to the surface of the polymer layer by embossing or forming layers of grain patterned elastic polymer on the fiber substrate by transfer coating. Japanese patent application publication No. 27636/81 describes an artificial leather which comprises a very thin polyurethane surface and an ultrafine fiber substrate, but fails to teach any melange-colored and super-entangled ultrafine fiber surface. Laid-open Japanese patent application publications Nos. 33221/78 and 106668/79 describe melange-colored artificial suede comprising ultrafine fiber naps extending from differently colored ultrafine fiber bundles. However, these references are silent about super-entangled surfaces of differently colored ultrafine fibers. Laid-open Japanese patent application No. 66188/82 describes a melange type sheet composed of two types of fibers, but the surface is buffed before dyeing to obtain artificial suede. Moreover it fails to teach ultrafine fiber bundles constituting the inner portion of the sheet.

In diversifying such technique of making grained artificial leather, attempts have been made to obtain melange-colored artificial leathers corresponding to the natural leather dyed with an aniline type dyestuff which shows varying shades, lighter and darker in various parts.

The aniline (synthetic dye) finish shows effective varying shades of surface color in the natural leather. However, the melange-colored grained sheet of the present invention includes not only such effect but also presents a complex grain pattern in two or more kinds of color such as in melange dyeing, which is hard to obtain in natural leather.

Processes have been used for providing different colors in conventional artificial leathers, as mentioned above, such as forming a layer of a mixture of elastic polymers containing different pigments, or coating unevenly with a gravure roll or spraying paints of different colors, However, these have both the disadvantages of falling-off of the provided different color layer due to abrasion or deterioration of the resin or vehicle, and the surface has a rubber-like or plastic feel due to the presence of the elastic polymer, coupled with a plastic appearance, all being much inferior to dignified aniline-finished natural leather.

Furthermore, even aniline-finished natural leather has the disadvantages of easily becoming bruised and easily stained because it is colored by splashing, which causes short life without constant maintenance. It is also unable to provide further complexity in color or a high-grade feeling with a sober color.

The present invention overcomes the disadvantages of conventional artificial leathers, such as falling-off of the melange-colored layer and the rubber-like or plastic feeling, as well as obtaining a complicated melange-colored effect, not obtainable even from natural leather. It further has the advantage of easy care.

SUMMARY OF THE INVENTION

It is an object of the present invention to provide a dignified novel sheet having a melange-colored surface with a high grade feeling and without any rubber-like or plastic feeling, and to provide a preparation method thereof. Another object of the present invention is to provide a melange-colored grained sheet having a complicated and delicate color mixing effect which cannot be obtained in natural leather. A method for producing the sheet is also provided.

The objects of the present invention can be attained by providing a novel melange-colored sheet having an inner portion and on at least one surface of the inner portion a portion comprising super-entangled ultrafine fibers and/or ultrafine fine fiber bundles comprising at least two types of ultrafine fibers, both of which are branched from the fiber bundles and/or multi-core fibers of the inner portion, wherein said bundles and/or multi-core fibers are different in color so that the surface presents at least two colors.

According to this invention, a method is provided for producing a novel melange-colored sheet having on at least one of the surfaces of the inner portion, a portion comprising super-entangled ultrafine fibers and/or ultrafine fiber bundles comprising at least two types of ultrafine fibers, which ultrafine fibers are branched from ultrafine fiber bundles and/or multi-core fibers of the inner portion, wherein said ultrafine fiber bundles and/or fibers are different in color so that said layer presents at least two colors, said method comprising the steps of:

(1) forming a fiber entangled sheet comprising at least two kinds of ultrafine fiber formable fiber bundles having different dyeing properties, (2) forming a super-entangled layer of ultrafine fibers and/or fine bundles of ultrafine fibers on at least one surface of said sheet by applying jet streams of high speed fluid, and (3) dyeing with different types of dyestuff.

Although specific examples of the invention have been selected for illustration in the drawings, they are not intended to limit the scope of the invention. Similarly, while specific terms will be used in the following description of the embodiments selected for illustration, these terms are not intended to limit the scope of the invention, which is defined in the appended claims.

DESCRIPTION OF THE PREFERRED EMBODIMENTS

Figure 1:
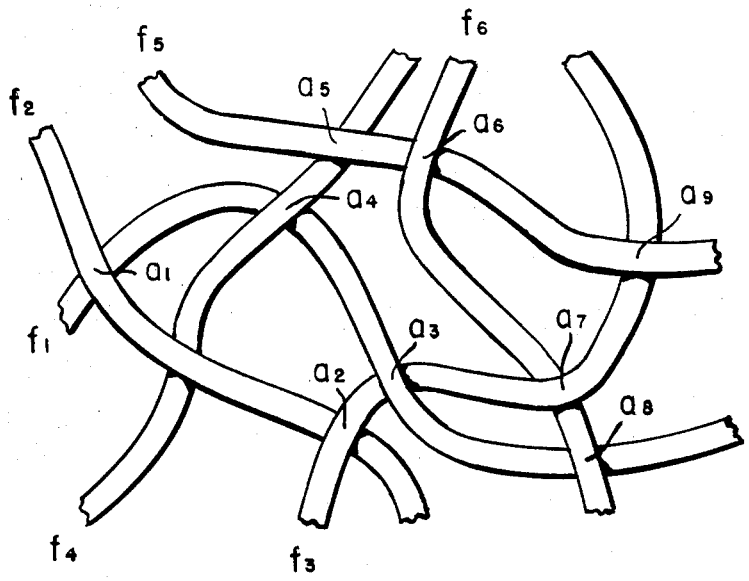
FIG. 1 is a schematic view of entangled constituent ultrafine fibers of the surface side of a sheet of the present invention.
Figure 4:
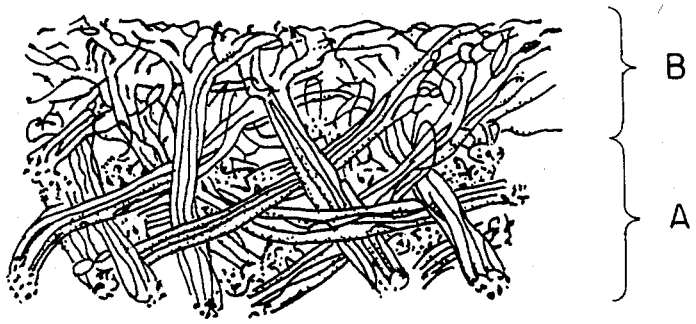
FIG. 4 is a schematic, idealized sketch showing, in vertical section, a portion of a fibrillated sheet in accordance with this invention, showing a superentangled surface portion which, after treatment, becomes a grained surface portion of the finished sheet.
Figure 2A:
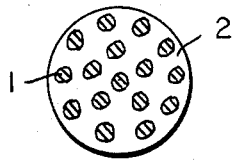
FIGS. 2(*a*) to 2(*o*) are schematic sectional views showing typical examples of fibers which may be used to form the ultrafine fibers employed in the present invention.
Figure 2B:
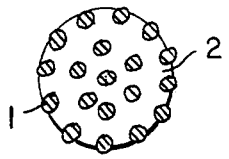
Figure 2C:
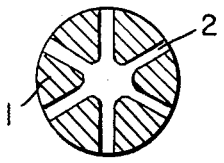
Figure 2D:
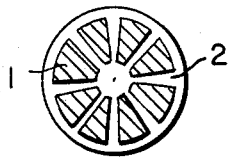
Figure 2E:
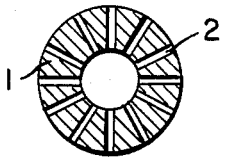
Figure 2F:
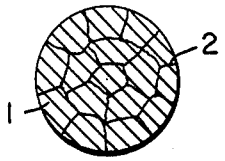
Figure 2G:
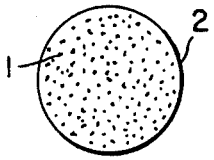
Figure 2H:
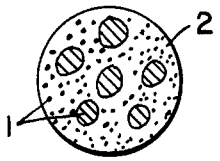
Figure 2I:
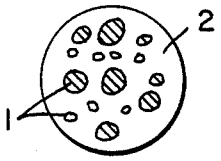
Figure 2J:
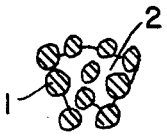
Figure 2K:
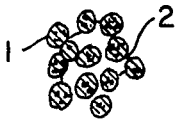
Figure 2L:
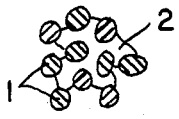
Figure 2M:
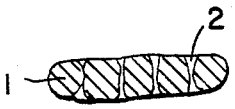
Figure 2N:
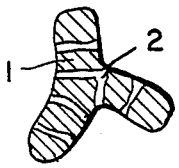
Figure 2O:
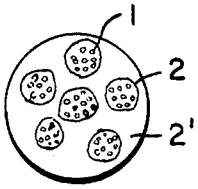

The term "ultrafine fiber bundle" as used herein denotes a fiber bundle in which a plurality of fibers in staple or filament form are arranged substantially in parallel with one another. The fibers may all be of the same type or a combination of fiber types.

The term "grained sheet" is not intended to be limited to leather alone, but is directed broadly to sheets composed of fibrous materials with surface fibers in fixed positions in any arrangement to provide a grain-like structure. It includes synthetic materials composed of fibers, fiber bundles or ultrafine fibers or bundles and resin in a wide variety of structural arrangements, including suede leathers and suede-like fabrics, including leather-like products having branched bundles of fibers or ultrafine fibers.

As used herein the term "grain" is intended to be directed broadly to a surface portion of the sheet, and refers particularly to ultrafine fibers or ultrafine fiber bundles, or mixtures of the two, branching from ultrafine fiber bundles of a sub-surface portion of the sheet, and a resin in the gap portions of the ultrafine fiber structure. The ultrafine fibers and ultrafine fiber bundles of the grain, in accordance with this invention, are superentangled, which is an important feature of the invention as will be explained in further detail hereinafter.

In some cases fibrous materials may be made having superentangled ultrafine fiber surfaces without any resin material on the surface thereof. Such surfaces are intended to be included within the scope of this invention but are not referred to as "grained" surfaces.

Having quite a different concept from the conventional aniline-style artificial leather, the melange-colored sheet of the present invention shows no vinyl or rubber feel due to the presence of any elastic polymer layer and is less susceptible to peeling-off from abrasion and deterioration, yielding quite an innovative different colored aniline effect. The melange-colored surface consists of a layer in which ultrafine fibers of not more than 0.5 denier, preferably extremely ultrafine fibers of not more than 0.2 denier, are super-entangled preferably as fibrils branched out of the fiber bundles. It presents at least two different colors or color shades. The melange-colored aniline effect of the surface attributed to the presence of the ultrafine fibers themselves is based on a concept quite different from the aniline finishing of natural leather. It has been impossible before the advent of the present invention to obtain the novel complex melange-colored aniline effect; it is not obtainable from natural leather. The present invention is further advantageous because it possesses an ease of care which is characteristic of artificial leather. The above-mentioned melange-colored effect is a unique feature of the grained surface layer of the sheet of this invention, and is essentially different from the melange effect of fluffy suede-type artificial leather.

Various ultrafine fibers may be used in the present invention. There may be mentioned those which are produced by various methods, such as super-drawing, jet spinning using a gas stream, and so forth. In accordance with these methods, however, spinning becomes unstable and difficult if the fiber size becomes too fine. For these reasons, it is preferred to employ particular types of fibers which are formable into ultrafine fibers and to modify them into ultrafine fibers at a suitable stage of the production process. Examples of such ultrafine formable fibers include multi-core fibers having chrysanthemum-like cross-sections in which one component is radially interposed between other components, multi-layered bicomponent type fibers, multi-layered bicomponent type fibers having a doughnut-like cross-section, mixed spun fibers obtained by co-extruding at least two components and spinning (in some cases a small amount of a second component, i.e. polyethylene glycol is very effective to separate a large amount of core component, i.e. polyethylene-terephthalate), islands-in-a-sea type multi-core fibers in which a plurality of ultrafine cores that are longitudinally continuous are bound together by other components, specific islands-in-a-sea fibers in which a plurality of extra-ultrafine cores are bonded together by other components to form a fiber, and so forth. Two or more of these fibers may be mixed.

It is preferable to use multi-core fibers in which a plurality of cores are interposed with other binding components, because it becomes easy to provide ultrafine fibers by applying physical or chemical action or by removing only the binding components.

It will be appreciated that the term "cores" as used herein is broadly applicable to ultrafine fibers or precursors thereof, in a wide variety of arrangements. A "core" does not need to be centrally located, or surrounded by other materials, but may be any one of a plurality of elements co-extruded into any of a wide variety of geometric shapes. Such "cores" may be embedded in a sea component, as shown in FIGS. 2(*a*) and 2(*h*) for example, or may be combined in a side-by-side arrangement as shown in FIG. 2(*m*) or 2(*n*), for example, or in a wide variety of other configurations.

FIGS. 2(*a*) to 2(*o*) show examples of selected multi-core fibers which may be used to obtain the ultrafine fibers. In FIGS. 2(*a*) to 2(i o), reference numbers 1 and 1' represent ultrafine cores and 2 and 2' represent binding components. The cores may be composite cores consisting of different polymeric materials. The cores may be crimpable cores, modified cross-section cores, hollow cores, multi-hollow cores and the like. Further, ultrafine cores of different kinds may be mixed.

Figure 3A:
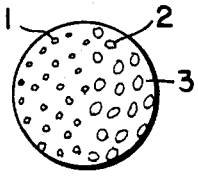
FIGS. 3(*a*) and 3(*b*) show, in cross section, fibers which may be used alone (and not necessarily in combination with other fibers) in accordance with this invention.
Figure 3B:
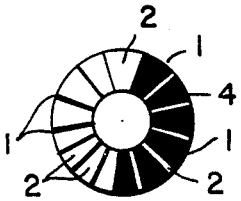

In FIG. 3(*a*) the number 1 designates a core of a particular kind (polyethylene terephthalate, for example). The number 2 designates a different core which has different dye-accepting properties (nylon 6-6, for example). The number 3 designates a sea component which may, for example, be polystyrene. It will accordingly be apparent that the melange-colored effect of this invention may be obtained from this multi-core fiber alone, because of the difference of dye reception of cores 1 and 2.

FIG. 3(*b*) shows a doughnut-shaped cross-section having a hollow portion 4 and a ring portion composed of wedge-shaped portions of two different polymers 1 and 2. For example, portions 1 may be polyethylene terephthalate and portions 2 may be nylon 6-6. It will be apparent that, after partial or complete mechanical or other separation, ultrafine fibers and fiber bundles having different dye receptive properties are provided.

The shapes of the cross-sections of ultrafine formable fibers used in the present invention also include wide varieties of sections such as round-shaped, fan-shaped triangle, fan-shaped frustum, cross-shaped, T-shaped triangle, roundish triangle-shaped, various multi-lobal shapes, hollow, hollow deformed and elliptical sections, for example.

In order to obtain a super-entangled leather, the size of the ultrafine fiber should not be greater than about 0.5 denier, preferably not greater than about 0.2 denier. A greater size results in inferior smoothness of the surface, making it impossible to accomplish the object of the present invention. Finer fibers may be used, even the finest. The order of 0.00001 denier is usually a practical limitation in preparation, without limiting the scope of the invention thereto.

As a matter of course, ordinary denier fiber or foreign substances such as additives may be permitted to coexist if the extent is limited in a manner not to spoil the effects of the present invention.

This means, for example, that a small amount of thick fiber not smaller than 0.9 denier may be included with a majority of ultrafine fibers. It also means that when an ultrafine fiber is made by splitting a multi-core fiber, the other component interposed among the ultrafine cores might remain as a relatively thick fiber or the ultrafine fiber itself might remain thick without being made ultrafine. Even in such a case the present invention can be fully accomplished if the amount of the remaining thick fiber remains in the minority. In any case, alterations not interfering with the functional effect of the present invention as a whole are included in the scope of the present invention.

In the fibrous sheet of the present invention a nonwoven fabric such as needle punched felt is preferred. However, a composite sheet in which woven or knitted fabric is present internally or on the back surface may be adapted. It is essential that the above-mentioned fibrous sheet has a surface portion comprising ultrafine fibers and/or bundles of ultrafine fibers, that both of those are branched from ultrafine fiber bundles or multi-core fibers of the inner portion and that said ultrafine fiber bundles and/or multi-core fibers are different in color or color shade.

If the surface structure is locally impregnated with a resin to fix the superentangled ultrafine fibers in place, a grained structure is obtained; embossing is advantageously used on such a grained surface.

If the surface layer has a structure according to the present invention, it may be combined with other fibrous sheets, and various combinations of layers may be provided.

It is required that the fiber structure in the sheet of the present invention be such that the ultrafine fibers and the fine bundles of ultrafine fibers are super-entangled with one another. In other words, it is necessary that the entanglement density of the fibers be high. One of the methods of measuring the entanglement density of the fibers is to measure the distances between representative fiber entanglement points. A short average distance between points of entanglement evidences a high density of entanglement.

The distance between the fiber entanglement points is desirably the mean of all entanglement distances. It is not necessary, of course, to measure all such distances since a representative sample is enough. The mean entanglement distance is measured in the following manner. FIG. 1 is an enlarged schematic view of the constituent fibers in the surface of a typical sample when viewed from the surface side. Assuming that the constituent fibers are $f_1$, $f_2$, $f_3$, . . . , the point at which two arbitrarily selected fibers $f_1$ and $f_2$ are entangled with each other is $a_1$, and the point at which the upper fiber $f_2$ is entangled with another fiber with the fiber $f_2$ being the lower fiber is $a_2$ (the entanglement point between $f_2$ and $f_3$). Similarly, the entanglement points $a_3$, $a_4$, $a_5$ . . . are located and positioned. The linear distances $a_1a_2$, $a_2a_3$, $a_3a_4$, $a_4a_5$, $a_5a_6$, $a_6a_7$, $a_7a_3$, $a_3a_8$, $a_8a_7$, $a_7a_9$, $a_9a_6$, . . . are measured along the surface of the sample. These are the distances between representative fiber entangling points which appear in FIG. 1. These distances are then added and divided by the number of measurements to give a mean.

In the present invention, the fibers of the surface must have an entanglement density of not greater than about 200 microns as measured by this method. This is what is meant where, in the specification and in the claims, we refer to the fibers as being "super-entangled". In fiber structures where the entanglement density is greater than about 200 microns, such as those fiber structures in which the entanglement of the fibers is effected only by needle punching, in which ultrafine fibers or bundles are merely arranged along the surface or, in which thickly raised ultrafine fibers or bundles are laid down on the surface of a substrate to form a grain, little or no entanglement of the fibers occurs.

When friction, crumpling and shearing stress are repeatedly applied to such fabrics the surface is likely to fluff in an unsightly manner or to develop cracks. To eliminate these problems, the mean distance between the fiber entangling points must be not greater than about 200 microns. More favorable results are obtainable when the mean distance is not greater than about 100 microns.

The fibrous grained sheet of the present invention may include various conventional kinds of viscoelastic polymers such as polyurethane and acryl resins and silicone rubber, for example. Such additives as pigments, dyestuffs or weather resistant agents may be added to the above-mentioned resins and a more complicated melange-color effect is obtainable by selecting appropriate pigments or dyestuffs.

A feature of the artificial leather according to the present invention is the exhibition of different colors by the ultrafine fibers constituting the surface. The foregoing feature is attainable by using various dyeing methods. A most effective method consists of making the ultrafine fibers constituting the surface from at least two kinds of ultrafine fibers which differ in dyeing properties from each other, and dyeing each fiber with different types of dyestuff.

According to differences in dyeing properties, the fibers may be classified as disperse dye dyeable type fibers, acid dye dyeable type fibers, basic dye dyeable type fibers or direct or reactive dye dyeable fibers, for example. From among these a combination of at least two different types of fiber bundles may be selected.

The disperse dye dyeable fibers include polyethylene-terephthalate, polyoxyethylenebenzoate, polybutylene-terephthalate as such or modified a little or to a large extent by copolymerization or blending with modifying agents, or polyamides with stiff skeletons, for example.

Examples of acid dye dyeable type fibers are polyamides having —$NH_2$ end groups and nylon 6, 66, 610 12 and PACM, for example, all of which are well known members of this type.

Typical of the basic dyeable fibers are the ones having —$SO_3Me$ (Me is metal) groups, especially —$SO_3Na$ group or mixtures, and the like.

Fiber forming polymers having the above-mentioned groups include acrylonitrile copolymers, or polyethylene-terephthalates or polybutylene-terephthalates copolymerized or mixed with isophthalic acid sodium sulfonate groups.

The direct or reactive dyeable fibers, the ones having sufficient reactive groups, are exemplified typically by fibers having —OH groups, including cellulose type and polyvinylalcohol types as conventional fibers; fibers other than these examples are of course included.

A mixture of at least two types of fiber bundles or multi-component fibers selected among the above-mentioned groups may be used in the portion constituting the grained surface.

Processes for making the mixture are generally divided into the following types described as follows by reference to individual embodiments.

(1) Two kinds of multi-core type fibers of the type capable of producing a bundle of ultrafine fibers consisting of cores having different dyeing properties, are mixed to form the surface of the sheet. Optionally, the fibers may be mix-spun or doubled with each other before use. In these cases, in place of said multi-component type fibers, bundles of ultrafine fibers obtainable by super drawing or melt-blowing may be used as well.

An example of the present process includes mixing two multi-core fibers whose island components are disperse dyes dyeable with another core component which is basic dye dyeable. The former core component polymer is exemplified by polyethylene-terephthalate and the latter by copolymerized polyethylene-terephthalate with 1–8 wt %, preferably, 2–5 wt % of isophthalic acid sodium-sulfonate.

The process further includes multi-core fibers whose core component is nylon 6 (the one including many amino end groups and of the acid dyeable type) mixed with the multi-core fiber of the above-mentioned basic dyeable type.

The mixing ratio (ratio between individual core components) may be determined arbitrarily, being selected in the range of about 1 to 99% by weight according to the purpose. The range of about 5 to 95% by weight can yield a remarkable effect. In general the ratio of fibers presenting a deeper color may preferably be kept at not more than about 50% by weight.

The multi-component type fiber used in the present invention does not require that the core component shall be completely surrounded by the sea component. Both components may be mutually clad in parallel, such as in the so-called separable types of multi-component type fibers. In any case, the sea component is separated and at least the core component or the component corresponding to the core component is used principally.

Although, when using the multi-component type fiber, the step of making the fiber ultrafine is carried out at an appropriate time before or after formation of the sheet, it is preferably conducted after formation of the fiber sheet according to the present invention, because of favorable processability and the possibility of producing a flexible artificial leather.

(2) A preferable feature of the present invention consists of the use of a three-component type of multi-core fiber that contains two kinds of core components which differ in dyeing properties, which are deposited on one side and the other side respectively, which structure generates two kinds of ultrafine fiber bundles. FIG. 3(*a*) shows an example of such fibers. In FIG. 3(*a*) reference numerals 1 and 2 represent two kinds of core components which differ in dyeing properties, and reference numeral 3 represents a binding component. This fiber is spun by a three-component composite spinning machine, and a bundle of fibers, in which two kinds of ultrafine fibers different in dyeing property are mixed, is obtained by removal of one component. Since said fiber already comprises a mixture, it requires no further yarn doubling and mixing, which in some cases may be carried out.

The multi-component type fiber that the present invention covers includes many different fiber cross sections, including the concept of making two kinds or more of ultrafine fibers by removing one component from a fiber of the separate or split-type consisting of three components.

Another process for obtaining a fiber bundle, in which two kinds of ultrafine fibers which differ in dyeing properties are mixed, includes a process in which two component type fibers such as those shown in FIG. 3(*b*), any of whose constituent components is not removed, is made ultrafine by separating or splitting. Typical of this process is the use of the split type multi-component type fiber consisting of polyamide and polyester. However, the latter has the disadvantage of difficulty of changing the mixing ratio to a large extent. This differs from the case of the previously described three components type. Changing the cross section increases the fibrillating effect of the high speed fluid treatment and often causes difficult separation and splitting. When the polyamide component is treated with a solution containing a chemical to facilitate separation and splitting, it sometimes becomes difficult to obtain the effect of the present invention for the following reasons: considerable change in the dyeing characteristic; embrittlement, shrinkage, and easy breaking during high speed fluid treatment. This type of process further includes a process of two colored yarn doubling ultrafine spinning.

A combination of processes of the above-mentioned processes may be used, of course.

In the foregoing cases, there is a common effect in the two colored dyeing of the surface or slight difference in each effect. Comparisons of these cases are described below.

Regarding the general trend, the effectiveness of the melange-colored, or aniline effect of surface is in the order of (1), (2) showing increasingly uniform appearance in the above-mentioned order. In particular, the closest uniformity generally results from (2). Various melange-colored properties are obtainable, ranging from components which are not so outstandingly different in color to others that are. All have their own uses, and should be appreciated together.

An example of a process for preparing sheets according to the present invention is as follows:

(1) Forming a sheet of two kinds of ultrafine fibers which have different dyeing properties.

(2) Applying a jet to at least one side of the sheet, the jet comprising a flow of high pressure fluid.

(3) Dyeing in different colors.

Figure 5:
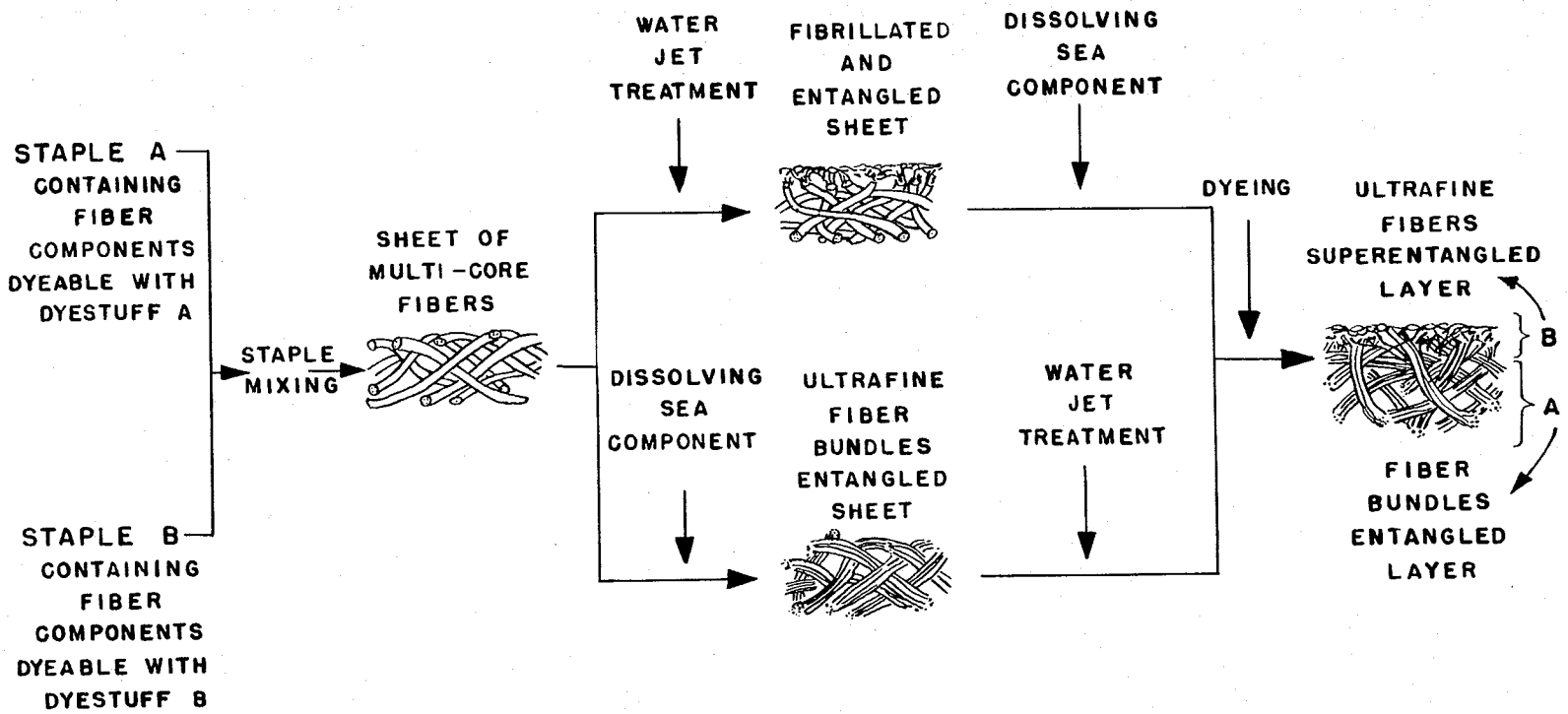
FIGS. 5 and 6 are schematic illustrations showing sheet structures at various stages in typical processes in accordance with selected embodiments of this invention.
Figure 6:
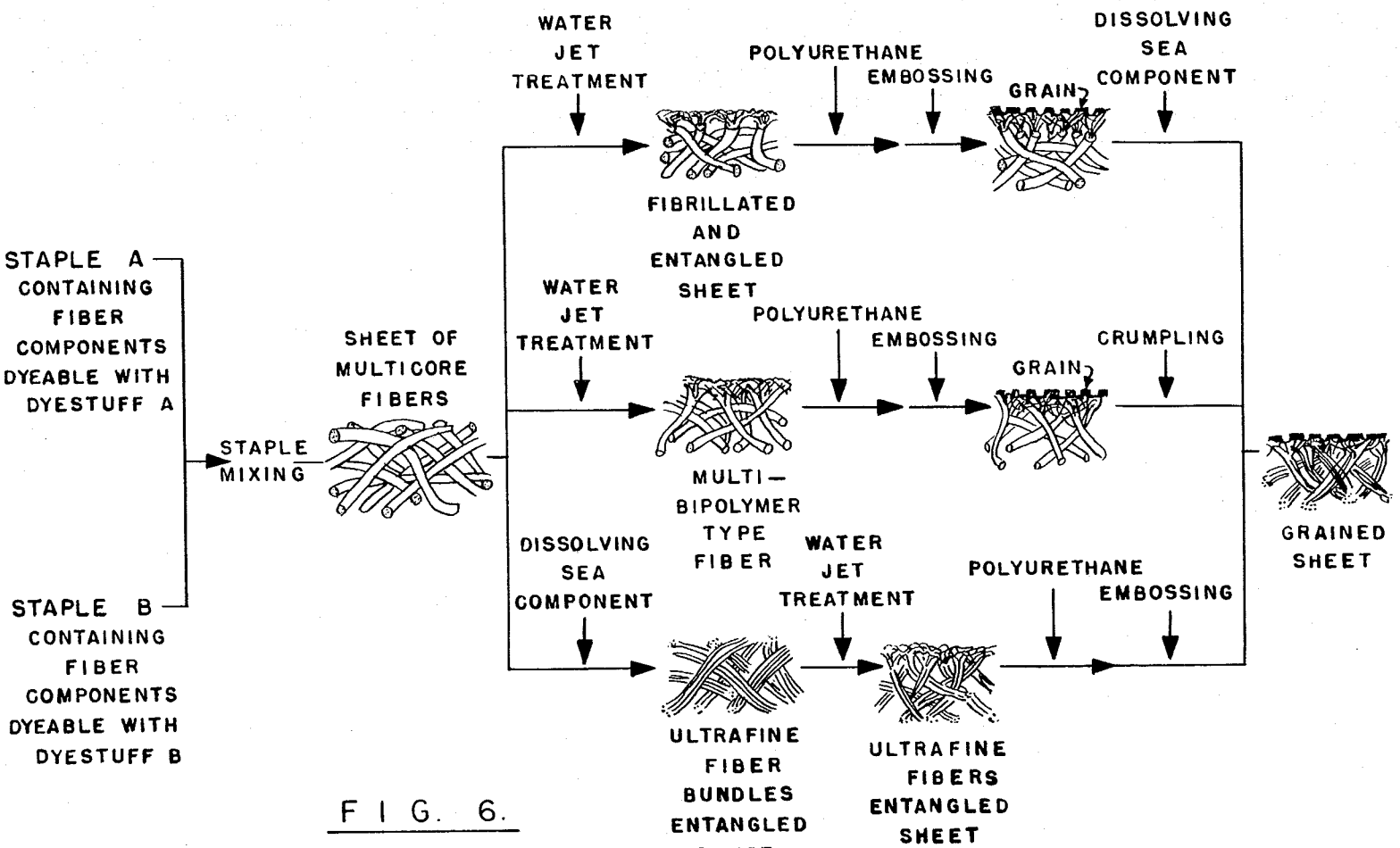

As to the order in which these process steps are carried out, there are various possibilities without limitation, as will be appreciated from an inspection of FIGS. 5 and 6 of the drawings. Treatment for making the fibers ultrafine is needed only in the case of using a multi-core fiber which is not yet ultrafine. The multi-core component may, if desired, be made ultrafine at the same time as the high speed fluid treatment or dyeing. Dyeing may be performed, preferably at a time following formation of the sheet.

It is, of course, possible that transparent resin layers may further be placed upon the melange-colored surface. In this case, if a small amount of pigment or dyestuff is applied to the resin layer to the extent that the melange-color is at least partially visible through the resin layer, the surface appearance presents more complicated forms and creates a unique melange-colored effect. One useful process for preparing a melange-colored sheet according to the present invention is described as follows:

Two kinds of multi-component type fibers (such as Staple A and Staple B of FIG. 5) which differ in dyeing properties as mentioned above are cut to a proper length, mixed as staple fibers and formed into a web through such processes as opening, carding and web forming. Next, the web is needle-punched. By jetting at least one side of the nonwoven sheet with a jet of high speed fluid, as shown in the upper processing route of FIG. 5, breakage of the sea component and fibrillation and entanglement of the fibrillated ultrafine fibers are carried out at the surface of the sheet. Subsequently, the sea component is dissolved and removed by the use of a liquid which is a solvent for the sea component, but a non-solvent for the core component. If necessary, the surface treated with a flow of high speed fluid is subjected to molding under pressure or pressing to form a grained-leather-like surface, followed by dyeing as described later.

Another process is shown by the lower processing route of FIG. 5. After producing a needle-punched nonwoven sheet as heretofore described, the sea component is dissolved and removed to make a sheet comprising ultrafine fiber bundles. At least one side or both sides of said sheet are then jetted with a high speed fluid and the ultrafine fiber bundles at the surface are subjected to fibrillation and entanglement to form a sheet having one or both super-entangled surfaces. Then, if necessary, the surface is molded under pressure, followed by dyeing. During or between these main process steps, any combination of usual artificial leather preparation techniques may be used. That is to say, the following techniques may be combined:

The nonwoven fabric may be shrunk before or after the high speed fluid jet treatment; resin liquid such as polyurethane solution may be applied after the high speed fluid jet treatment. The resin is applied to surround the superentangled fibers or fiber bundles and followed by wet coagulation or dry coagulation.

FIG. 6 of the drawings shows various alternative routes for making grained melange-colored surfaces, in which a resin is applied to the superentangled ultrafine melange-colored surface fibers of the sheet. The upper route of FIG. 6 shows application of polyurethane followed by embossing to provide a grained pattern, followed by dissolving the sea component. The middle route of FIG. 6 shows use of a bi-polymer structure in which the individual cores are mechanically separated by crumpling the sheet after embossing, instead of dissolving out a sea component as before. The bottom route of FIG. 6 shows embossing after the sea component has been dissolved out.

Both sides of rather thick nonwoven sheet may be subjected to high speed fluid treatment and sliced during a subsequent process; a temporarily-binding polymer such as polyvinyl alcohol may be supplied before removal of the sea component and later removed by extraction during the subsequent process; resin liquid such as the solution of temporarily-binding polymer and polyurethane elastomer may be applied after the high speed fluid treatment, and may be followed by wet coagulation or dry coagulation and subsequent extraction (removal) of the temporarily-binding polymer; appropriate resin is applied to the super-entangled surface before the pressure molding or pressing.

Regarding the fluid used as the high speed fluid jet, water is most preferred, but organic solvents or alkali or acid solutions may be used according to the purpose. Such fluid is pressurized by a high pressure pump and is jetted through a nozzle of a small diameter or a slit having a narrow gap against the surface of the nonwoven sheet in the form of high speed columnar streams or a curtain stream. In the process in which jetting is carried out before making the ultrafine fiber bundle, a relatively high pressure condition is preferred such as one ranging from about 70 to 300 kg/cm$^2$, because both effects are needed including breaking the sea component or peeling off the sea component to make fibrils of the fibers, and super-entangling the fibrillated fiber surfaces.

On the other hand, in jetting after the ultrafine fiber bundle has been made, a relatively low pressure condition is sufficient, a satisfactory range being of the order of about 5 to 200 kg/cm$^2$, because breaking the sea component or peeling off the constituent component are not required. In order to avoid development of impact locus due to jetting, it is effective to oscillate the jet nozzle or sheet relative to one another, or to repeat the jet treatment a number of times.

By jetting with high speed fluid, the fibrous portion at or near the surface is effected by the jet stream and the fibers are divided and branched out into fibrils of ultrafine fibers and said fibrils are entangled to produce a superentangled surface having an extremely high density.

The dyeing process according to the present invention includes a single-bath dyeing process and a multi-bath dyeing process. These features and the manner in which they may be carried out are as follows:

The one-bath dyeing process can shorten the dyeing period but involves problems of formation of precipitates by reaction between different kinds of dyestuffs. Further, contamination is encountered due to the presence of different kinds of dyestuffs. Hence it is necessary to use a limited combination of dyestuffs and to use anti-precipitants. However, since contaminated dyestuffs cannot be completely eliminated, the problems of clarity of color and fastness of dyeing remain, and there are limitations in depth, lightness and clarity of color. In the multi-bath dyeing process, there is no fear of formation of precipitates, and further, the process has the advantage of providing clear colors and dyeing fastness by adopting the so-called intermediate cleaning process.

The process called the one-bath multi-stage dyeing process is included within the meaning of the expression "one-bath dyeing process" according to the present invention. It has properties intermediate the one-bath dyeing process and the multi-bath dyeing process. Both processes are conventional per se and the process of the present invention may be carried out in accordance with either of them. It is necessary, however, to select a combination of dyestuffs which are dyed into two colors or two color shades, as will be discussed in detail.

One of the preferable embodiments of the present invention is to dye the sheet which contains fibers having different dyeability, with only one type of dye. In such a case, some fibers are dyed and the others remain undyed (colorless) to show a melange effect. Three or more components of fiber bundles or ultrafine fibers can also been used, with separate, sequential dyeing steps to obtain the desired number of colors in the melange effect.

As used herein the expression "melange colors" means that there is a difference in main wavelength between two colors, after being measured by a color difference meter or the like. This difference should not be less than about 5 m, preferably not less than about 10 m. However, even when the difference between main wavelengths is smaller than 5 m, or a remarkable difference between deep and light colors can be visually recognized, the effect is intended to be included in the expressions "melange colors" or "melange-colored surface" as used in the present invention. In this case, the criterion is that two kinds of colored fibers can be distinguished with the naked eye.

A grained sheet having a melange-colored surface of the present invention has a variety of uses such as clothing, industrial use, furniture, wall decoration and interiors. In this connection various additional processing steps may be applied, such as coating with finishing resin, repelling water, rubbing and scuffing and the treatment such as thickness adjusting process including slicing and buffing. In particular, it can be effectively utilized in fields where emphasis is especially placed on tints of color.

Examples according to the present invention appear below; the present invention is not limited or restricted thereby. Parts and percentages are all by weight.

EXAMPLE 1

Two different multi-core fibers were prepared:

(1) Staple A of 51 mm length having about 12 crimps/in, which had a denier of 3.8 after drawing and which was a multi-component type fiber consisting of 60% of core component (the number of cores was 72 filaments) composed of copolymerized polyethylene-terephthalate with 2.4 wt/% of isophthalic acid sodium sulfonate and 40% of a sea component composed of polystyrene.

(2) Staple B of about 51 mm length and having a crimp of about 9 to 12 crimps/in, was a multi-component type fiber consisting of 80% of core component having a denier of 4.5 after drawing, (the number of cores was 72 filaments) and composed of poly-ε-caproamide having an amino end group, as core component, and 20% of a sea component composed of polystyrene.

Equal amounts of Staples A and B were subjected to mixing, carding, cross lapper processing and needle punching (3500 needles/cm$^2$), in that order. A needle-punched felt having a weight of 530 g/m$^2$ was obtained.

Both sides of said needle-punched felt were jetted with columnar streams of water ejected at a pressure of 100 kg/cm$^2$ through jet nozzles having apertures arranged along a line and having a diameter of 0.1 mm and a distance pitch of 0.6 mm between the centers of the apertures. The jet treatment was repeated four times, each followed by drying. Next, after being impregnated with a 5% dimethylformamide solution of polyester type polyurethanes, the sheet was dried after wet coagulation with water and was treated with trichloroethylene. The polystyrene of the sea component of both multi-core fibers was thus removed.

The sheet was sliced into two pieces. The jet treated surfaces of said both sheets were coated (4 g/m$^2$) with a two-pack polyurethane solution using a gravure coater and were embossed at 160° C. by embossing rolls on which a grain pattern for leather was carved, and a raw sheet having a grained surface was obtained.

The grained sheet was dyed as follows:

(1) One-bath dyeing conditions were used. (A/B=50/50, on a fiber basis after removal of the sea component).

Dyeing with a cationic dye and an acid dye in the same bath was conducted according to the following conditions:

| | |
|---|---|
| Cathilon Red CD-RLH | 3% |
| Kayanol Milling Blue-GW | 3% |
| Ospin KB-30F (manufactured by Tokai Seiyu) | 4% |
| Acetic acid (90%) | 0.5 cc/l |
| Anhydrous Glauber's salt | 40 g/l |
| Bath ratio | 1:50 |
| Dyeing temperature and time | 120° C. × 60 min. |

After dyeing, the contaminated dye was soaped out under the following conditions:

| | |
|---|---|
| Sundet G-29 (Manufactured by Sanyo Chemical Industries, Ltd.) | 1.0 g/l |
| Acetic acid (90%) | 0.5 cc/l |
| Bath ratio | 1:50 |
| Treatment temperature and time | 70° C. × 20 min. |

In order to improve the dyeing fastness of the acid dye, fixing was carried out under the following conditions:

| | |
|---|---|
| Nylon Fix TH (Manufactured by Nippon Senka Kogyo) | 4% |
| Formic acid | 1% |
| Bath ratio | 1:50 |
| Treatment temperature and time | 80° C. × 20 min. |

(2) Two-bath dyeing (A/B=10/90, on a basis after removal of the sea component).

Using cationic dyestuff, the side composed of isophthalic acid sodium sulfonate copolymer with polyethylene-terephthalate was dyed under the following conditions:

| | |
|---|---|
| Cathilon Black CD-BLH | 18% |
| Ospin KB-30F | 4% |
| Acetic acid | 0.5 cc/l |
| Anhydrous Glauber's salt | 40 g/l |
| Bath ratio | 1:50 |

-continued

| | |
|---|---|
| Dyeing temperature and time | 120° C. × 60 min. |

After dyeing and copolymerized polyethylene terephthalate with the isophthalic acid sodium sulfonate, for removing cationic dyestuff contaminated on the poly-ε-caproamide side, cleaning was effected under the following conditions:

| | |
|---|---|
| Sodium hydrosulfite | 2.9 g/l |
| Soda ash | 1.0 g/l |
| Sundet G-29 | 1.0 g/l |
| Bath ratio | 1:50 |
| Treatment temperature and time | 70° C. × 20 min. |

Next, the polyε-caproamide side was dyed with the acid dyestuff under the following conditions:

| | |
|---|---|
| Mitsui Nylon Black GL | 2% |
| Ospin KB-30F | 4% |
| Ammonium sulfate | 4 g/l |
| Bath ratio | 1:50 |
| Dyeing temperature and time | 98° C. × 60 min. |

After dyeing, soaping was carried out under the following conditions:

| | |
|---|---|
| Sundet G-29 | 1.0 g/l |
| Acetic acid | 0.5 cc/l |
| Bath ratio | 1:50 |
| Treatment temperature and time | 70° C. × 20 min. |

Thus the grained surface of the grained sheet of the present invention, obtained by use of the one-bath dyeing conditions under (1), presented a melange-colored surface which looked violet in color from a distance but which had the appearance at a short distance of sober and high grade colors containing randomly mixed red and blue colors. This was a grained sheet with a true natural sensation; even after being abraded with sandpaper the surface suffered only slight flaws and the color tone still remained superior in comparison with conventional artificial leather having a polyurethane film. The latter, when abraded, had a poor appearance as a result of peeling of the polyurethane film.

The grained sheet of the present invention, as produced by the two-bath dyeing conditions under (2), also had a sober melange-colored grained surface having as a whole a grey tone containing mixed grey and black colors. Further, the distance between fiber entangling points in the grained surface layer was 80 microns.

EXAMPLE 2

The following mixture was prepared:

(1) Staple A of 51 mm length having 4.0 denier with crimps; it consisted of a multi-core type fiber; the core component was polyethylene-terephthalate containing 0.05% of titanium oxide, the core component content was 80%, the number of cores was 36 filaments, and the sea component was 20% polystyrene.

(2) Staple B having the same constitution as (1) of Example 1, but the number of cores was 36 filaments.

By subjecting staple A and staple B to mixing so that the core ratio after removal of the sea component was 60/40, a needle-punched felt of about 250 g/m$^2$ was obtained by the same procedure as in Example 1.

After being treated with an aqueous solution of polyvinyl alcohol and dried and shrunk, the needle-punched felt was treated with perchloroethylene to dissolve out the polystyrene sea component. Next, after showering with hot water to remove the polyvinyl alcohol, the following treatment was repeated three times, following by drying: the surface of one side was jetted with oscillation with high pressure water streams at a pressure of 60 kg/cm$^2$ through a nozzle which had a hole diameter of 0.09 mm. The holes were arranged in one row at an interval of 0.6 mm. Subsequently, after the surface portion of the resulting sheet had been impregnated with a 10% polyurethane emulsion solution and dried, the surface was subjected to embossing at 140° C. by embossing rolls on which a grain pattern was carved, and a raw sheet having a grained surface was obtained. Under the following conditions the resulting material was subjected to a dyeing treatment in which a disperse dye and a cationic dye were used in the same bath.

| | |
|---|---|
| Sumikaron Red E-FBL | 10% |
| Astorason Blue GL | 5% |
| Acetic acid (90%) | 1.0 cc/l |
| Sodium acetate | 0.15 g/l |
| Anhydrous Glauber's salt | 3.0 g/l |
| Sumipon TF (Manufactured by Sumitomo Chemical Co., Ltd.) | 1.0 g/l |
| Bath ratio | 1:50 |
| Dyeing temperature and time | 120° C. × 60 min. |

After dyeing, reduction cleaning was conducted under the following conditions:

| | |
|---|---|
| Sodium hydrosulfite | 2.0 g/l |
| Soda ash | 1.0 g/l |
| Amylasine D | 1.0 g/l |
| Bath ratio | 1:50 |
| Treatment temperature and time | 70° C. × 20 min. |

The grained layer in the present example, obtained through hot water cleaning and water cleaning carried out thoroughly after reduction cleaning, had a mean distance of 160 microns between fiber entangling points. The grained sheet had a sober melange-colored surface of violet tone, and when viewed closely the red and violet colors were finely mixed. This product also achieved an important object of the present invention, that is, the surface was free of any vinyl or rubbery feeling and provided the same natural sensation as natural leather. The melange-colored tone was retained even after abrasion.

EXAMPLE 3

Fibers were prepared under the following conditions:

(1) 50 parts of copolymerized polyethylene terephthalate/5-sodiumsulfoisophthalate copolymer (weight ratio: 97.6/2.4) and 50 parts of copolymer of styrene and higher grade alcohol ester of acrylic acid (80/20) were blended in the molten state and spun. Staple A (51 mm, 4.0 denier) having a multi-core construction (core component: polyester, sea component: copolymer) was obtained in the ordinary way.

(2) Staple B ( 51 mm, 4.0 denier) was obtained in a similar way as Staple A except that the core component was poly-ε-capramide.

Both staples were subjected to mixing (A/B=60/40) and to temporary needle punching using 500 needles/cm$^2$ after web formation through carding and cross lapping to make a felt.

On the other hand, the mixture of Staple A and Staple B in Example 2 were similarly subjected to temporary needle punching using 500 needles/cm$^2$ to make a felt. Both felts were superimposed upon each other, and were further needle punched using 1500 needles/cm$^2$, on both sides. A layered felt having a weight of 450 g/m$^2$ as a whole was obtained.

In the same manner as Example 1, said felt was subjected to high pressure water stream treatment on both sides, to polyurethane impregnation and to sea-removal, and was finished except without slicing. A sheet having super-entangled surfaces on both sides was obtained.

When this product was dyed, using a one-bath dyeing condition according to (1) of Example 1, one surface had a melange-colored tone in which red and blue were mixed as in Example 1, and the other surface had another melange-colored tone in which red was mixed with white color (colorless). The resulting grained sheet, the sides of which had different melange-colored tones, was suitable as a reversible material.

Furthermore, two different melange-colored tone grained sheets were obtained by slicing. The distance between fiber entangling points was 55 microns.

Next, thin polyurethane layers (containing 0.2% carbon black) of 10 microns thickness were formed on both surfaces with a gravure coater. Both surfaces changed into a deep and sober tone while maintaining a melange color visible through the polyurethane layers.

EXAMPLE 4

The following two kinds of multi-core fibers were prepared.

(1) Staple A (51 mm in length, 4.0 denier) of specific islands-in-a-sea type fibers (16 islands) which have a large number of the extra-ultrafine cores in each islands. The fibers are composed of 60 parts of copolymer of styrene and 2-ethylhexylacrylate (80/20) as a binding component, and 40 parts of nylon 6 as a extra-ultrafine core component. The average size of the extra-ultrafine cores was about 0.0003 denier.

(2) Staple B (51 mm in length, 4.0 denier) of specific islands-in-a-sea type fibers (16 islands) which have a large number of the extra-ultrafine cores in each islands. The fibers are composed of 60 parts of polystyrene copolymerized with 20 mol % of 2-ethylhexylacrylate as a binding component, and 40 parts of polyethylene terephthalate as a extra-ultrafine core component. The average size of the extra-ultrafine cores was about 0.0003 denier.

Staple A and B were mixed so that the core ratio A/B after removal of the sea component was 30/70.

The mixed staples were passed through a card and a cross lapper to form a web. The web was then needle-punched using needles, each having one hook, so as to entangle the specific island-in-a-sea type fibers with one another and to produce a non-woven fabric. The resulting non-woven fabric had a weight of about 450 g/m$^2$ and an apparent density of 0.18 g/cm$^3$.

The resulting non-woven fabric was then impregnated with a 10% aqueous dispersion of polyethylene glycol (molecular weight 200) monolaurate and was subseguently dried so as to plasticize the binding component. A large number of columnar streams of water pressurized to 100 kg/cm$^2$ were jetted once to each surface of the sheet using the same jet nozzle as used in Example 1 while the nozzle was being oscillated, followed by drying of the sheet.

Thereafter, the sheet was repeatedly dipped into trichloroethylene and sgueezed to extract and substantially remove the binding component of the fiber. The sheet was then dried and was dyed with acid dyestuff under the condition according to second step of (2) of Example 1 using a normal-pressure winch dyeing machine. After a softening agent was applied, the sheet was crumpled and finished.

The resulting leather-like sheet had a weight of 180 g/m$^2$, and apparent density of 0.29 g/cm$^3$, showed a melange-colored effect comprising dark gray and white (undyed), and excellent flexibility. Both surface had also supple and smooth touch like that of higher grade natural leather, in spite of containing no binder.

The average distance between the fiber entangling points of the constituent fibers of both surfaces was measured. It was found to be 25 microns.

We claim:

1. A novel melange-colored sheet having a body portion comprising (a) at least two types of fibers in a form selected from ultrafine fiber bundles, multi-core fibers and a mixture of ultrafine fiber bundles and multi-core fibers or comprising (b) multi-core fibers having at least two types of core components which are disposed on one side and the other side respectively, and a super-entangled surface portion on at least one of the surfaces of said body portion, said super-entangled surface portion having ultrafine fibers to fine bundles of ultrafine fibers branching from said ultrafine fiber bundles or said multi-core fibers of said body portion, said two types of ultrafine fiber bundles or said two types of core components of said body portion being different in color so that said super-entangled surface portion visually presents at least two colors.

2. A novel melange-colored sheet as defined in claim 1, wherein said super-entangled ultrafine fibers to fine bundles of ultrafine fibers have entangling points arranged at measurable distances from each other, and wherein the average distance between said entangling points is not greater than about 200 microns.

3. A novel melange-colored sheet as defined in claim 1 or 2, wherein said super-entangled ultrafine fibers to fine bundles of ultrafine fibers are branched from said ultrafine fiber bundles of said inner portion, and the degree of branching of said fiber bundles changes gradually from the inner portion to the surface portion.

4. A novel melange-colored sheet as defined in claim 1 wherein said surface layer is covered by a transparent resin layer.

5. A novel melange-colored sheet as defined in claim 4, wherein the transparent resin layer is colored.

6. A novel melange-colored sheet as defined in claim 1, comprising a grained sheet wherein said surface layer is impregnated with a resin to form a grained layer.

7. A novel melange-colored grained sheet as defined in claim 6, wherein said resin is colored.

8. A method of producing a novel melange-colored sheet having an inner portion comprising (a) fibers in a form selected from at least two types of ultrafine fiber bundles and multi-core fibers or comprising (b) multi-core fibers having at least two types of core components which are disposed on one side and the other side respectively, and a surface comprising super-entangled ultrafine fibers to fine bundles of ultrafine fibers branching from said fiber bundles or said multi-core fibers of the inner portion, said two types of ultrafine fiber bundles or said two types of core components being different in color so that said superentangled surface visually presents at least two colors, said method comprising the steps of:

(1) forming a fiber entangled sheet comprising multicomponent fibers capable of converting into at least two types of bundles of ultrafine fibers having different dyeing properties, (2) forming a superentangled layer of ultrafine fibers to fine bundles of ultrafine fibers on the surface of said sheet by applying to at least one side of the sheet a jet stream of high speed fluid, and (3) dyeing the resulting surface with different types of dyestuffs.

9. The method defined in claim 8, wherein said fiber bundles include a sea component, and wherein the fluid jet treatment is followed by removing at least a portion of the sea component.

10. The method defined in claim 8, wherein said fiber bundles include a sea component, and wherein the fluid jet treatment is applied to the sheet surface after the sea component has been removed.

11. The method defined in claim 8, wherein said fiber bundles include ultrafine cores which are adhered to each other, and wherein at least some of said cores are mechanically separated from one another by crumpling the sheet.

12. The method defined in claim 11, wherein the crumpling step is applied subsequently to the jet stream treatment.

13. The method defined in claim 12, wherein a resin is applied to the sheet surface after said jet treatment but before said crumpling step.

* * * * *